US012669250B2

(12) United States Patent
Zhou et al.

(10) Patent No.: US 12,669,250 B2
(45) Date of Patent: Jun. 30, 2026

(54) WALL-MOUNTED AIR CONDITIONER

(71) Applicants: GD MIDEA HEATING & VENTILATING EQUIPMENT CO., LTD., Foshan (CN); HEFEI MIDEA HEATING & VENTILATING EQUIPMENT CO., LTD., Hefei (CN)

(72) Inventors: Baisong Zhou, Foshan (CN); Duode Wu, Foshan (CN); Yuan Yang, Foshan (CN); Bo Li, Foshan (CN); Yongqiang Wan, Foshan (CN); Qiqin Su, Foshan (CN); Yunchong Tu, Foshan (CN)

(73) Assignees: GD MIDEA HEATING & VENTILATING EQUIPMENT CO., LTD., Foshan (CN); HEFEI MIDEA HEATING & VENTILATING EQUIPMENT CO., LTD., Hefei (CN)

( * ) Notice: Subject to any disclaimer, the term of this patent is extended or adjusted under 35 U.S.C. 154(b) by 371 days.

(21) Appl. No.: 18/563,915

(22) PCT Filed: Feb. 11, 2022

(86) PCT No.: PCT/CN2022/076097
§ 371 (c)(1),
(2) Date: Nov. 24, 2023

(87) PCT Pub. No.: WO2022/252686
PCT Pub. Date: Dec. 8, 2022

(65) Prior Publication Data

US 2025/0085001 A1 Mar. 13, 2025

(30) Foreign Application Priority Data

Jun. 1, 2021 (CN) ..... 202110610656.5

(51) Int. Cl.
*F24F 1/0057* (2019.01)
*F24F 1/0063* (2019.01)
*F24F 11/89* (2018.01)

(52) U.S. Cl.
CPC ..... *F24F 1/0057* (2019.02); *F24F 1/0063* (2019.02); *F24F 11/89* (2018.01); *F24F 2221/17* (2013.01)

(58) Field of Classification Search
CPC ..... F24F 1/0057; F24F 1/0063; F24F 11/89; F24F 2221/17
See application file for complete search history.

(56) References Cited

U.S. PATENT DOCUMENTS 5,211,219 A 5/1993 Kawabata et al.
2018/0119984 A1 5/2018 Cho et al.

FOREIGN PATENT DOCUMENTS

CN 210441336 U 5/2020
CN 215372681 U 12/2021
(Continued)

OTHER PUBLICATIONS

The Request for the Submission of an Opinion received in the counterpart KR application 10-2023-7037298, mailed on Nov. 20, 2025, 8 pages with English translation.
(Continued)

*Primary Examiner* — William C Doerrler
(74) *Attorney, Agent, or Firm* — K&L Gates LLP

(57) ABSTRACT

Provided is a wall-mounted air conditioner, comprising a housing and a heat exchanger. An air duct is provided in the housing; the air duct comprises an air inlet and an air outlet; the air duct comprises an air inflow section and an air outflow section that are connected to each other; at least a portion of the air inlet is located on the front side of the housing; and the heat exchanger is disposed in the air duct.
(Continued)

The air inflow section horizontally or obliquely extends forward from the air outflow section to form a first mounting space behind the air inflow section; and/or the portion of the air outflow section adjacent to the air outlet extends downward and forward from the remaining portion of the air outflow section to form a second mounting space behind the air outflow section.

17 Claims, 4 Drawing Sheets

(56) References Cited

FOREIGN PATENT DOCUMENTS

| | | | | |
|---|---|---|---|---|
| EP | 668473 | B1 | | 4/2001 |
| EP | 2829814 | A1 | | 1/2015 |
| JP | S57160025 | U | | 10/1982 |
| JP | H04161730 | A | | 6/1992 |
| JP | H07229636 | A | | 8/1995 |
| JP | H08110085 | A | | 4/1996 |
| JP | H09166334 | A | | 6/1997 |
| JP | H10103706 | A | * | 4/1998 |
| JP | H11148706 | A | | 6/1999 |
| JP | 2000035228 | A | | 2/2000 |
| JP | 2002156134 | A | | 5/2002 |
| JP | 2002156135 | A | * | 5/2002 |
| JP | 2004084973 | A | | 3/2004 |
| JP | 2005195199 | A | | 7/2005 |
| JP | 2005300153 | A | | 10/2005 |
| JP | 2007322006 | A | | 12/2007 |
| JP | 2010145057 | A | | 7/2010 |
| JP | 2014052183 | A | | 3/2014 |
| KR | 20090022103 | A | | 3/2009 |
| WO | 9819112 | A1 | | 5/1998 |

OTHER PUBLICATIONS

Search Report for EP application 22814735.1; mailed Jun. 11, 2024.
ISR received in PCT application PCT/CN2022/076097; mailed Apr. 20, 2022.
OA for JP application 2023565289; mailed Oct. 29, 2024.
The First Office Action received in the counterpart CN application 2021106106565, mailed on Mar. 31, 2025, 13 pages with English translation.
The Request for the Submission of an Opinion received in the counterpart KR application 10-2023-7037298, mailed on Mar. 17, 2025, 17 pages with English translation.
The Examination report No. 2 for standard patent application received in the counterpart AU application 2022286886, mailed on Mar. 17, 2025, 4 pages.

* cited by examiner

WALL-MOUNTED AIR CONDITIONER

CROSS-REFERENCES TO RELATED APPLICATIONS

The present disclosure is a national phase application of International Application No. PCT/CN2022/076097, filed on Feb. 11, 2022, which claims priority to and benefits of Chinese Patent Application No. 202110610656.5, filed on Jun. 1, 2021, the entire content of which is incorporated herein by reference.

FIELD

This application relates to the field of air conditioners, and more particularly to a wall-mounted air conditioner.

BACKGROUND

In the related art, an air inlet of a wall-mounted air conditioner is at its top. In order to meet a requirement for air inflow from the top, the wall-mounted air conditioner has to be at a large distance from an indoor top wall, resulting in low indoor space utilization and making the indoor space more cramped. In some embodiments, the wall-mounted air conditioner in the related art has low heat exchange efficiency. In addition, some components in the air conditioner (such as electric control components, pipelines, circuits, throttling components, etc.) are usually mounted on a side (e.g., a left side and/or a right side) of a length direction of an air duct, which may lengthen the air conditioner's body and increase the installation difficulty.

SUMMARY

The present disclosure aims to solve at least one of the problems existing in the related art. Accordingly, embodiments of the present disclosure propose a wall-mounted air conditioner.

The wall-mounted air conditioner according to embodiments of the present disclosure includes a housing and a heat exchanger. An air duct is arranged in the housing, the air duct has an air inlet and an air outlet, and the air duct includes an air inflow section and an air outflow section connected to each other, at least a part of the air inlet being on a front surface of the housing. The heat exchanger is arranged in the air duct. The air inflow section extends horizontally or obliquely forwards from the air outflow section, to define a first mounting space behind the air inflow section; and/or a part, adjacent to the air outlet, of the air outflow section extends downwards and forwards from a remaining part of the air outflow section, to define a second mounting space behind the air outflow section; and/or a third mounting space is defined between the air inflow section and the air outflow section.

According to the present disclosure, since at least a part of the air inlet of the wall-mounted air conditioner is on the front surface of the housing, ambient air (air inflow) can enter the air duct substantially from the front of the housing. For example, the ambient air (air inflow) can enter the air duct from the straight front of the housing, or from the top front of the housing, or from the bottom front of the housing. In addition, the ambient air can enter the air duct from at least two directions selected from the straight front of the housing, the top front of the housing, or from the bottom front of the housing.

That is, the ambient air does not necessarily enter the air duct directly above the housing. In such a way, a distance between the wall-mounted air conditioner and an indoor top wall can be greatly decreased or even eliminated, and the utilization rate of indoor space can be improved, especially for indoor space (rooms) with lower heights, which can effectively reduce or eliminate a cramped sense of the indoor space.

Therefore, the wall-mounted air conditioner according to embodiments of the present disclosure has a very low requirement for mounting space. As long as the wall-mounted air conditioner can be accommodated in the mounting space, there is no need to leave an air inflow space above the wall-mounted air conditioner, which can expand the applicability of the wall-mounted air conditioner.

In some embodiments, in a scenario of air inflow from the top, the top space is often restricted and relatively narrow, which limits the air inflow volume due to the narrow top space. In the embodiment of this application, since at least a part of the air inlet is located on the front surface of the housing, the air entering the air duct through the air inlet can directly flow through the heat exchanger for sufficient heat exchange with the heat exchanger. That is, the air inflow volume of the wall-mounted air conditioner is not limited by the narrow space at the top. The air inflow from the front surface of the housing can effectively increase the air inflow volume and significantly increase the air flow volume through the heat exchanger, greatly enhancing the heat exchange efficiency of the heat exchanger.

In the present disclosure, since at least a part of the air inlet is located on the front surface of the housing, there is no need to mount a roughly inverted V-shaped heat exchanger below the air inlet, and it is unnecessary to mount a water receiving tray with a width greater than or equal to a width of the roughly inverted V-shaped heat exchanger at a lower end of the heat exchanger, to avoid failure in heat exchange of air with a part of the heat exchanger due to the part being obstructed by the water receiving tray. Since at least a part of the air inlet is located on the front surface of the housing, the water receiving tray will not prevent airflow from flowing to the heat exchanger. For example, the water receiving tray does not pass an airflow path to the heat exchanger, which can greatly improve the heat exchange efficiency of the heat exchanger. In some embodiments, the water receiving tray is located below the heat exchanger.

Therefore, the wall-mounted air conditioner in the embodiments of the present disclosure has advantages of easy installation, improved indoor space utilization, wide applicability, and high heat exchange efficiency.

In addition, the wall-mounted air conditioner according to the embodiments of the present disclosure provides one or more of the first mounting space, the second mounting space and the third mounting space, which can be used to mount components that are originally mounted on a side (e.g., a left side and/or a right side) of a length direction of the air duct. For example, electric control components, pipelines, circuits, throttling components and the like can be mounted in one or more of the first mounting space, the second mounting space, and the third mounting space. As a result, the internal space utilization efficiency and integration of the wall-mounted air conditioner; the structure of the wall-mounted air conditioner becomes more compact and reasonable; the length of the wall-mounted air conditioner can be decreased, the installation difficulty and space required for the wall-mounted air conditioner can be reduced.

Therefore, the wall-mounted air conditioner according to the embodiments of the present disclosure has advantages of high utilization rate of the internal space, compact structure, small length, low installation difficulty, and small space required for installation.

In some embodiments, the wall-mounted air conditioner further includes a first component, a second component, and a third component, and one or more of the first component, second component, and the third component are mounted in any of the first mounting space, the second mounting space, and the third mounting space.

In some embodiments, the first component is mounted in the first mounting space, the second component is mounted in the second mounting space, and the third component is mounted in the third mounting space.

In some embodiments, the first component is a throttling component; the second component includes air conditioner pipelines and/or wires; and the third component is an electric control component.

In some embodiments, an air duct wall of the air inflow section includes a first air inflow plate and a second air inflow plate, and an air duct wall of the air outflow section includes a first air outflow plate and a second air outflow plate; the third mounting space is defined among the second air inflow plate, the second air outflow plate, and a front plate of the housing; the first mounting space is behind the first air inflow plate, and the second mounting space is behind the first air outflow plate.

In some embodiments, the second air inflow plate includes a sunken part that forms a water receiving sink for receiving condensate water from the heat exchanger.

In some embodiments, a rear surface of the first air inflow plate and/or a rear surface of the first air outflow plate is provided with a water tank having an opening facing upwards; the first mounting space is above the water tank and the second mounting space is below the water tank; and the water tank is arranged obliquely and communicated with the water receiving sink.

In some embodiments, the third mounting space is on a side of the sunken part facing away the water receiving sink.

In some embodiments, the first air outflow plate includes a first flat plate portion adjacent to the air outlet, and the second air outflow plate includes a second flat plate portion adjacent to the air outlet. A first intersection angle between the second flat plate portion and a centerline of the air outflow section is greater than 0 degree and less than or equal to 30 degrees; or a second intersection angle between the first flat plate portion and the second flat plate portion is greater than or equal to 5 degrees and less than or equal to 45 degrees.

In some embodiments, a third intersection angle between a centerline of the air inflow section and a centerline of the air outflow section is greater than or equal to 10 degrees and less than or equal to 85 degrees.

In some embodiments, a fourth intersection angle between a centerline of the air outflow section and a vertical upward direction is greater than or equal to 120 degrees and less than or equal to 155 degrees.

Embodiments of the present disclosure will be given in part in the following descriptions, become apparent in part from the following descriptions, or be learned from the practice of the embodiments of the present disclosure.

Figure 1:
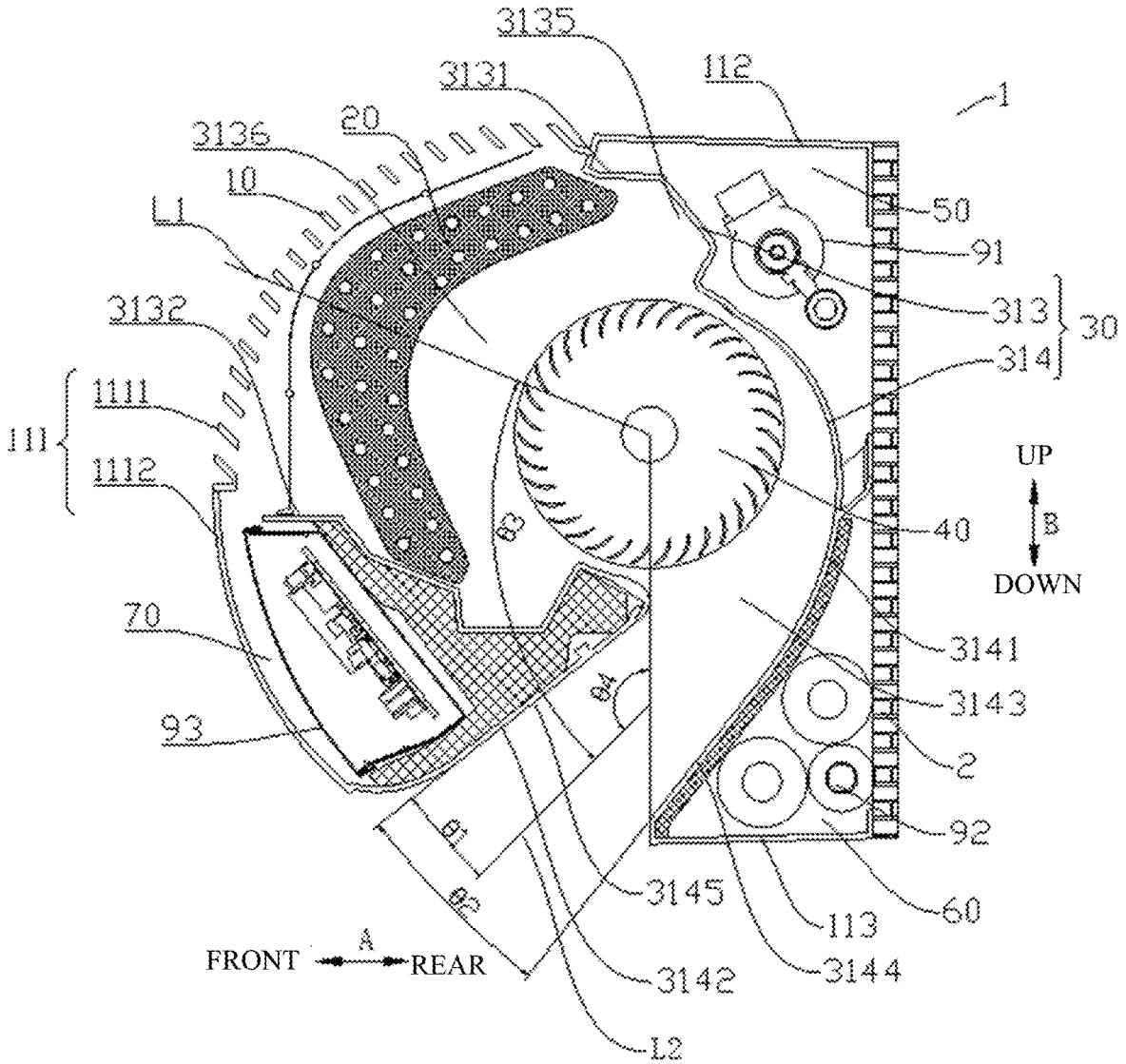
FIG. 1 is a sectional view of a wall-mounted air conditioner according to embodiments of the present disclosure.

REFERENCE NUMERALS wall-mounted air conditioner 1, wall surface 2, top wall 3, housing 10, front surface 11, front plate 111, rear surface 1110 of front plate 111, upper plate portion 1111, lower plate portion 1112, top plate 112, bottom plate 113, heat exchanger 20, air duct 30, air inlet 311, air outlet 312, air inflow section 313, first air inflow plate 3131, second air inflow plate 3132, side surface 31321, sunken part 3133, water receiving sink 3134, avoidance groove 3135, inlet air duct 3136, air outflow section 314, first air outflow plate 3141, second air outflow plate 3142, side surface 31421, outlet air duct 3143, first flat plate portion 3144, second flat plate portion 3145, fan wheel 40, first mounting space 50, second mounting space 60, third mounting space 70, water tank 80, throttling component 91, air conditioner pipeline 92, electric control component 93, centerline L1 of air inflow section, centerline L2 of air outflow section.

DETAILED DESCRIPTION OF THE DISCLOSURE

Embodiments of the present disclosure will be described in detail below, and examples of the embodiments will be shown in the accompanying drawings. The embodiments described below are exemplary and are intended to explain the present disclosure rather than limit the present disclosure.

The present disclosure is based on the inventors' discovery and understanding of the following facts and issues.

Figure 4:
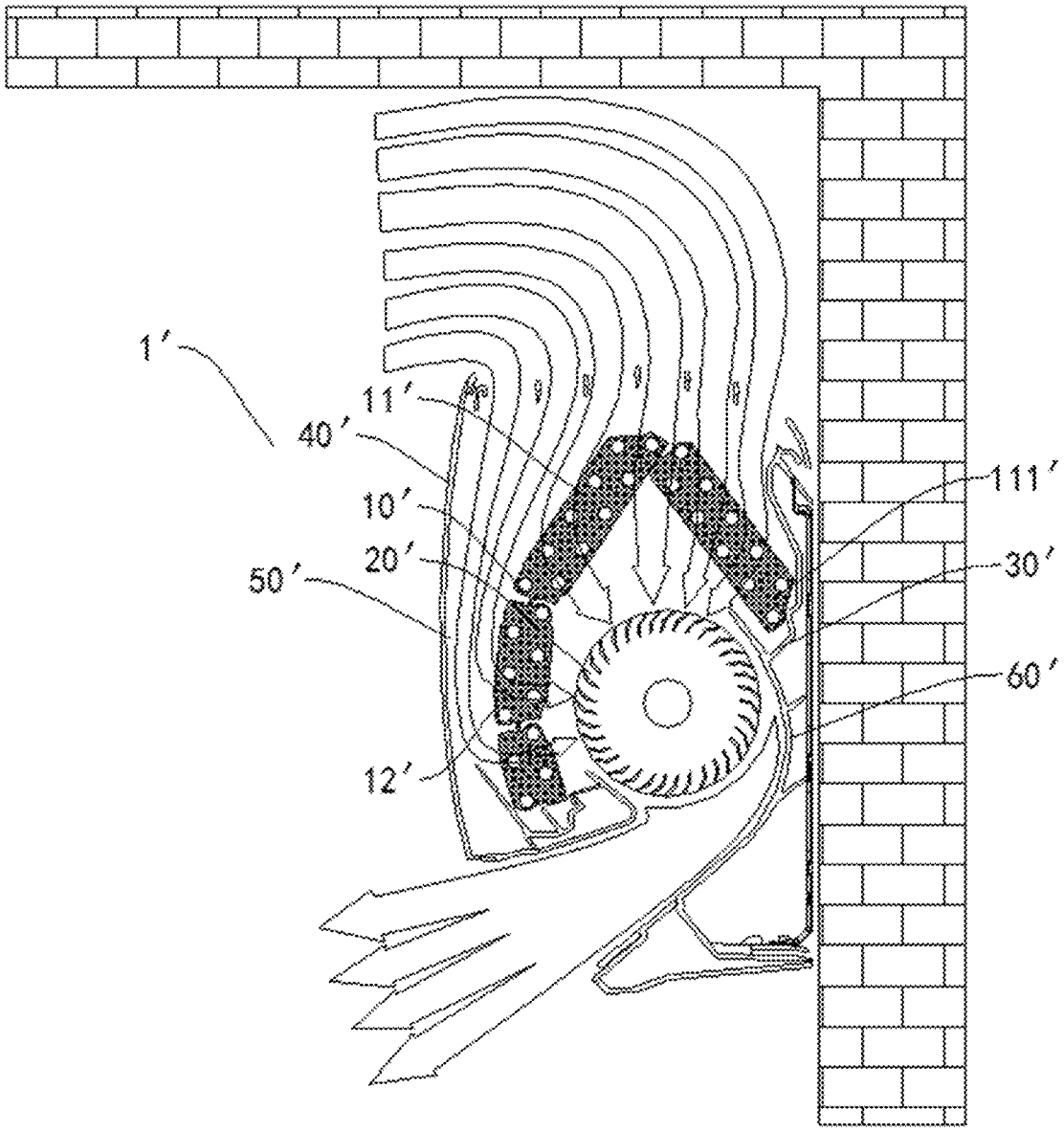
FIG. 4 is a sectional view of a wall-mounted air conditioner in the related art.

In the related art, as shown in FIG. 4, an air inlet of a wall-mounted air conditioner 1' is located at its top, and the top of the wall-mounted air conditioner 1' has to be at a large distance from an indoor top wall 3, to define an air inflow space. Consequently, the wall-mounted air conditioner 1' cannot be arranged tightly against the indoor top wall 3. A heat exchanger 10' of the wall-mounted air conditioner 1' is arranged around a cross-flow fan wheel 20'. Specifically, a first part 11' of the heat exchanger 10', which forms a roughly inverted V-shape, is located above the cross-flow fan wheel 20', and a second part 12' of the heat exchanger 10' is located in front of the cross-flow fan wheel 20'.

A water receiving tray 30' is provided below a rear lower end 111' of the first part 11'. The water receiving plate 30' is opposite to the rear lower end 111' of the first part 11' in an up-down direction and is located between the rear lower end 111' of the first part 11' and the cross-flow fan wheel 20'. The inventors have realized that the rear lower end 111' of the first part 11' is obstructed by the water receiving tray 30', and the rear lower end 111' of the first part 11' does not exchange heat with air, resulting in waste and lowering heat transfer efficiency.

An inlet air duct 50' is formed between the second part 12' and a front panel 40' of the wall-mounted air conditioner 1'. However, the inventors have realized that since most of the space in a front-rear direction of the wall-mounted air conditioner 1' is occupied by the heat exchanger 10', the cross-flow fan wheel 20' and a volute 60', the inlet air duct 50' is relatively narrow, resulting in a small air flow volume through the inlet air duct 50' and a low heat transfer efficiency of the second part 12'.

A wall-mounted air conditioner 1 according to embodiments of the present disclosure will be described below according to FIGS. 1 to 3. As shown in FIG. 1, the wall-mounted air conditioner 1 includes a housing 10, a heat exchanger 20, and an air duct 30. The air duct 30 is located inside the housing 10, and the heat exchanger 20 is located inside the air duct 30. The air duct 30 includes an air inflow section 313 and an air outflow section 314 connected to each other. The air duct 30 has an air inlet 311 and an air outlet 312. The air inlet 311 is located in the air inflow section 313, and the air outlet 312 is located in the air outflow section 314.

At least a part of the air inlet 311 is located on a front surface 11 of the housing 10. The front surface 11 of the housing 10 is a surface that can be seen by a horizontal backward line of sight, that is, a surface of the housing 10 that can be seen by the horizontal backward line of sight is the front surface 11 of the housing 10. For example, when an observer's eyes are roughly at the same level as the housing 10 and the observer is in front of the housing 10, a surface of the housing 10 that the observer can see is the front surface 11 of the housing 10.

A front-rear direction is shown by arrow A in FIG. 1, and an up-down direction is shown by arrow B in FIG. 1. For example, the wall-mounted air conditioner 1 is mounted on a wall surface 2. A direction away from the wall surface 2 in the horizontal direction represents a forward direction, and a direction heading to the wall surface 2 in the horizontal direction represents a rearward direction.

The housing 10 has a mounting space therein. There may be one or more kinds of mounting spaces.

The air inflow section 313 extends horizontally or obliquely forwards from the air outflow section 314 to define a first mounting space 50 behind the air inflow section 313. In other words, the air inflow section 313 extends horizontally or obliquely forwards from its connection with the air outflow section 314, defining a mounting space, i.e., the first mounting space 50, behind the air inflow section 313, which is configured to mount components of the air conditioner.

In some embodiments, a part, adjacent to the air outlet 312, of the air outflow section 314 extends downwards and forwards from a remaining part of the air outflow section 314, to define a second mounting space 60 behind the air outflow section 314. In other words, the air outflow section 314 includes the part adjacent to the air outlet 312 and the remaining part except for that part. The part, adjacent to the air outlet 312, of the air outflow section 314 extends downwards and forwards from its connection with the remaining part, defining a mounting space i.e., the second mounting space 60, behind the air outflow section 314, which is configured to mount components of the air conditioner.

In some embodiments, a third mounting space 70 is defined between the air inflow section 313 and the air outflow section 314. It should be noted that the third mounting space 70 is located in front of at least a part of the air duct 30 and can be configured to mount components of the air conditioner.

According to the present disclosure, since at least a part of the air inlet of the wall-mounted air conditioner is on the front surface of the housing, ambient air (air inflow) can enter the air duct substantially from the front of the housing. For example, the ambient air (air inflow) can enter the air duct from the straight front of the housing, or from the top front of the housing, or from the bottom front of the housing. In addition, the ambient air can enter the air duct from at least two directions selected from the straight front of the housing, the top front of the housing, or from the bottom front of the housing.

That is, the ambient air does not necessarily enter the air duct directly above the housing. In such a way, a distance between the wall-mounted air conditioner and an indoor top wall can be greatly decreased or even eliminated, and the utilization rate of indoor space can be improved, especially for indoor space (rooms) with lower heights, which can effectively reduce or eliminate a cramped sense of the indoor space.

Therefore, the wall-mounted air conditioner according to embodiments of the present disclosure has a very low requirement for mounting space. As long as the wall-mounted air conditioner can be accommodated in the mounting space, there is no need to leave an air inflow space above the wall-mounted air conditioner, which can expand the applicability of the wall-mounted air conditioner.

In some embodiments, the air inlet 311 is located on the front surface, inclined upwards towards the wall surface 2 (which can be understood as a mounting surface) relative to a vertical surface. In this way, when a user standing on the ground of the room, the user cannot see the interior of the housing 10 (the wall-mounted air conditioner 1) through the air inlet 311, and internal structures of the housing 10 (the wall-mounted air conditioner 1) are not exposed to the user, which can improve the user's visual comfort.

In some embodiments, in a scenario of air inflow from the top, the top space is often restricted and relatively narrow, which limits the air inflow volume due to the narrow top space. In the embodiments of this application, since at least a part of the air inlet is located on the front surface of the housing, the air entering the air duct through the air inlet can directly flow through the heat exchanger for sufficient heat exchange with the heat exchanger. That is, the air inflow volume of the wall-mounted air conditioner is not limited by the narrow space at the top. The air inflow from the front surface of the housing can effectively increase the air inflow volume and significantly increase the air flow volume through the heat exchanger, greatly enhancing the heat exchange efficiency of the heat exchanger.

In the present disclosure, since at least a part of the air inlet is located on the front surface of the housing, there is no need to mount a roughly inverted V-shaped heat exchanger below the air inlet, and it is unnecessary to mount a water receiving tray with a width greater than or equal to a width of the roughly inverted V-shaped heat exchanger at a lower end of the heat exchanger, to avoid failure in heat exchange of air with a part of the heat exchanger due to the part being obstructed by the water receiving tray. Since at least a part of the air inlet is located on the front surface of the housing, the water receiving tray will not prevent airflow from flowing to the heat exchanger. For example, the water receiving tray does not pass an airflow path to the heat exchanger, which can greatly improve the heat exchange efficiency of the heat exchanger. In some embodiments, the water receiving tray is located below the heat exchanger.

Therefore, the wall-mounted air conditioner in the embodiments of the present disclosure has advantages of easy installation, improved indoor space utilization, wide applicability, and high heat exchange efficiency.

In addition, the wall-mounted air conditioner according to the embodiments of the present disclosure provides one or more of the first mounting space, the second mounting space and the third mounting space, which can be used to mount components that are originally mounted on a side (e.g., a left side and/or a right side) of a length direction of the air duct. For example, electric control components, pipelines, circuits, throttling components and the like can be mounted in one or more of the first mounting space, the second mounting space, and the third mounting space. As a result, the internal space utilization efficiency and integration of the wall-mounted air conditioner; the structure of the wall-mounted air conditioner becomes more compact and reasonable; the length of the wall-mounted air conditioner can be decreased, the installation difficulty and space required for the wall-mounted air conditioner can be reduced.

Therefore, the wall-mounted air conditioner according to the embodiments of the present disclosure has advantages of high utilization rate of the internal space, compact structure, small length, low installation difficulty, and small space required for installation.

Specific embodiments according to the present disclosure will be described in detail below in conjunction with FIGS. 1 and 2. In some embodiments, the wall-mounted air conditioner 1 is mounted on the wall surface 2 indoors.

Figure 2:
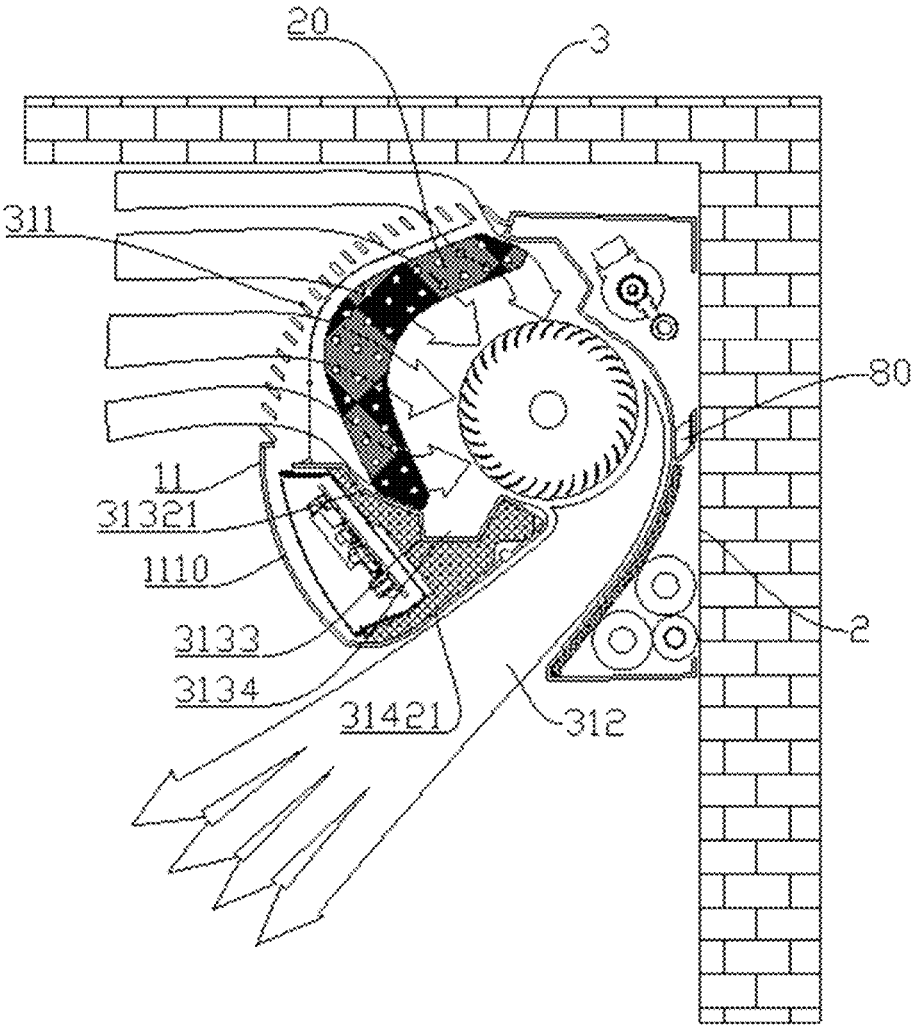
FIG. 2 is a sectional view of a wall-mounted air conditioner according to embodiments of the present disclosure.
Figure 3:
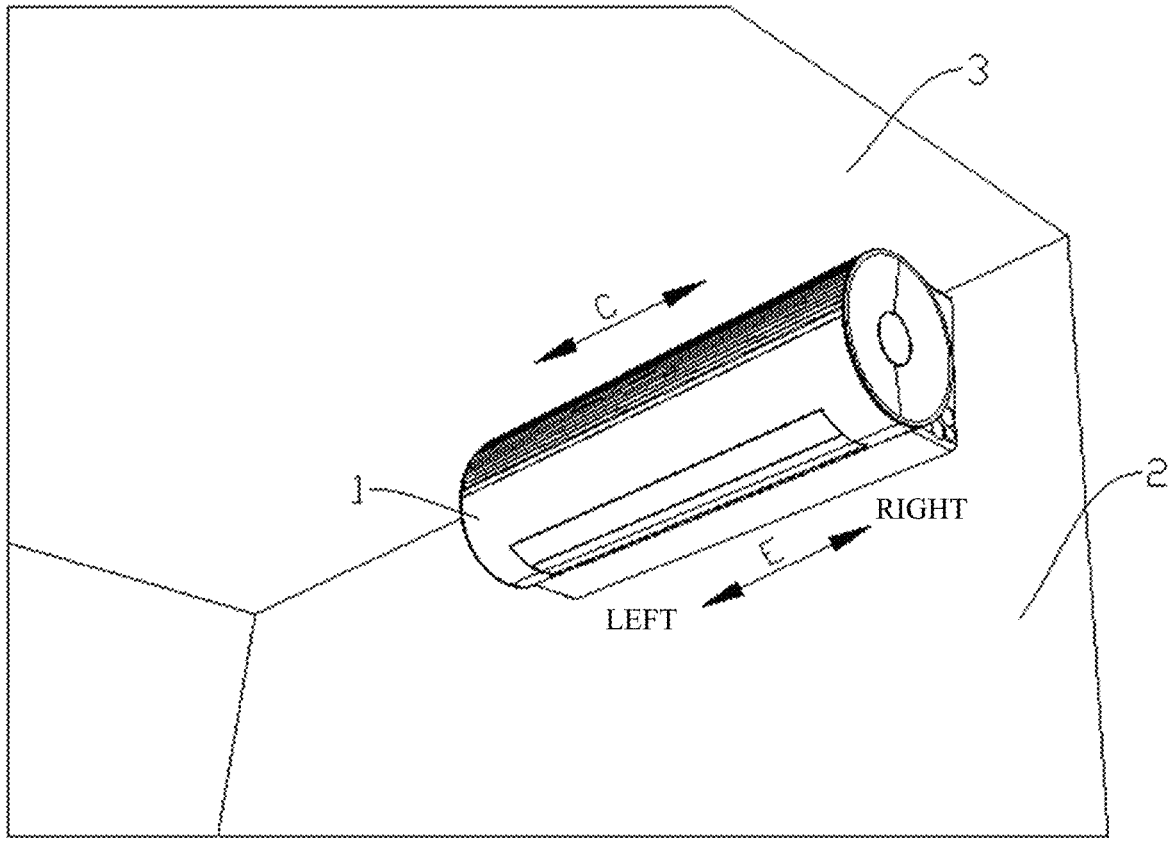
FIG. 3 is a schematic view of a wall-mounted air conditioner according to embodiments of the present disclosure.

As shown in FIGS. 1 and 2, the wall-mounted air conditioner 1 includes the housing 10, the heat exchanger 20, the air duct 30 inside the housing 10, and a fan wheel 40 in the air duct 30. The housing 10 includes a front plate 111, and the air inlet 311 is on the front plate 111.

In some embodiments, when the housing 10 is mounted on the wall surface 2, a distance between a top surface of the housing 10 and the indoor top wall 3 is less than or equal to 20 centimeters. In other words, a minimum distance between the housing 10 and the indoor top wall 3 in the up-down direction is less than or equal to 20 centimeters. Hence, the utilization rate of indoor space can be further improved.

In some embodiments, the distance between the top surface of the housing 10 and the indoor top wall 3 is less than or equal to 15 centimeters. In some embodiments, the distance between the top surface of the housing 10 and the indoor top wall 3 is less than or equal to 10 centimeters. In some embodiments, the distance between the top surface of the housing 10 and the indoor top wall 3 is less than or equal to 8 centimeters. In some embodiments, the distance between the top surface of the housing 10 and the indoor top wall 3 is less than or equal to 5 centimeters. In some embodiments, the top surface of the housing 10 is in contact with the indoor top wall 3, i.e., the distance between the top surface of the housing 10 and the indoor top wall 3 is equal to 0 centimeter. Hence, the utilization rate of indoor space can be further improved.

The air duct 30 includes the air inflow section 313 and the air outflow section 314. The air inflow section 313 forms an inlet air duct 3136, while the air outflow section 314 forms an outlet air duct 3143. The air inlet 311 of the air duct 30 is at an end of the inlet air duct 3136, and the air outlet 312 of the air duct 30 is at an end of the outlet air duct 3143. The heat exchanger 20 is arranged inside the inlet air duct 3136 and at the air inlet 311. The heat exchanger 20 is corresponding to the air inlet 311 to exchange heat with air entering the inlet air duct 3136 from the air inlet 311.

A part of the fan wheel 40 is located in the inlet air duct 3136, and another part of the fan wheel 40 is located in the outlet air duct 3143. The fan wheel 40 is used to generate air exhaust force, allowing air entering the inlet air duct 3136 from the air inlet 311 to subsequently enter the outlet air duct 3143 through the fan wheel 40, and finally be discharged from the air outlet. The arrangement of the fan wheel 40 in the air duct 30 can increase the flow volume and velocity of air passing through the heat exchanger 20, to further improve the heat exchange efficiency of the heat exchanger 20 and the wall-mounted air conditioner 1.

As shown in FIG. 1 and FIG. 2, the air inflow section 313 obliquely extends forwards and upwards from its connection with the air outflow section 314. The first mounting space 50 is behind the air inflow section 313. It can be understood that the first mounting space 50 is in front of the wall surface 2.

It should be noted that in other embodiments, the air inflow section 313 may also extend horizontally forward from its connection with the air outflow section 314, or the air inflow section 313 may also extend downwards from its connection with the air outflow section 314. In some embodiments, the air inflow section 313 obliquely extends forwards and upwards from its connection with the air outflow section 314 to make the structure of the wall-mounted air conditioner 1 more reasonable.

Further, the part, adjacent to the air outlet 312, of the air outflow section 314 extends downwards and forwards from the remaining part of the air outflow section 314. The air outlet 312 is located at a lower part of the housing 10. The second mounting space 60 is behind the air outflow section 314. It can be understood that the second mounting space 60 is in front of the wall surface 2.

The above arrangement of the air inflow section 313 and the air outflow section 314 causes the air duct 30 to be substantially V-shaped with an opening facing forwards, and the air inflow section 313 is above the part, adjacent to the air outlet 312, of the air outflow section 314. The third mounting space 70 is between the air inflow section 313 and the air outflow section 314, i.e., in the opening of the substantially V-shaped air duct 30.

The first mounting space 50, the second mounting space 60, and the third mounting space 70 can all be configured to mount components of the air conditioner. That is, the components of the air conditioner can be mounted in at least one of the first mounting space 50, the second mounting space 60, and the third mounting space 70.

In some embodiments, the wall-mounted air conditioner 1 according to the present disclosure includes a first component, a second component, and a third component. One or more of the first component, the second component, and the third component are mounted in any of the first mounting space 50, the second mounting space 60, and the third mounting space 70. That is, the first mounting space 50, the second mounting space 60, and the third mounting space 70 can mount one or more components of the air conditioner.

In order to make the structure of the wall-mounted air conditioner 1 more reasonable, improve the utilization rate of the internal space, and realize more compact layout and shorter length, in some embodiments, the first component is mounted in the first mounting space 50, the second component is mounted in the second mounting space 60, and the third component is mounted in the third mounting space 70.

In some embodiments, as shown in FIGS. 1 and 2, the first component is a throttling component 91; the second component includes air conditioner pipelines 92 and/or wires; and the third component is an electric control component 93. The throttling component 91 is mounted in the first mounting space 50, the air conditioning pipelines 92 are mounted in the second mounting space 60, and the electric control component 93 is mounted in the third mounting space 70.

Further, an air duct wall of the air inflow section 313 includes a first air inflow plate 3131 and a second air inflow plate 3132, and the inlet air duct 3136 is formed between the first air inflow plate 3131 and the second air inflow plate 3132. An air duct wall of the air outflow section 314 includes a first air outflow plate 3141 and a second air outflow plate 3142, and the outlet air duct 3143 is formed between the first air outflow plate 3141 and the second air outflow plate 3142. For example, the first air outflow plate 3141 is a volute tongue structure, and the second air outflow plate 3142 is a volute wheel structure.

As shown in FIGS. 1 and 2, the first mounting space 50 is behind the first air inflow plate 3131, and the second mounting space 60 is behind the first air outflow plate 3141. The third mounting space 70 is defined among the second air inflow plate 3132, the second air outflow plate 3142, and the front plate 111 of the housing 10.

Specifically, as shown in FIGS. 1 and 2, the third mounting space 70 is defined among a side surface 31321 of the second air inflow plate 3132 away from the inlet air duct 3136, a side surface 31421 of the second air outflow plate 3142 away from the outlet air duct 3143, and a rear surface 1110 of the front plate 111. The first mounting space 50 is in an upper and rear position within the wall-mounted air conditioner 1, and the second mounting space 60 is in a lower and rear position within the wall-mounted air conditioner 1. The third mounting space 70 is in a front and lower position within the internal space of the housing 10.

The housing 10 includes a top plate 112 and a bottom plate 113. A first end of the top plate 112 is connected to the first air inflow plate 3131 and extends backwards; and a second end of the top plate 112 abuts against the wall surface 2. The first mounting space 50 is below the top plate 112. A first end of the bottom plate 113 is connected to the first air outflow plate 3141 and extends backwards; and a second end of the bottom plate 113 abuts against the wall surface 2. The second mounting space 60 is above the bottom plate 113. In some embodiments, both the top plate 112 and the bottom plate 113 extend along a horizontal plane.

As shown in FIGS. 1 and 2, further, in some embodiments, the front plate 111 is a curved plate protruding forwards, and the front plate 111 includes an upper plate portion 1111 and a lower plate portion 1112. The upper plate portion 1111 is an upper portion of the front plate 111, the lower plate portion 1112 is a lower portion of the front plate 111, and the upper plate portion 1111 is above the lower plate portion 1112. The air inlet 311 is on the upper plate portion 1111; the third mounting space 70 is behind the lower plate portion 1112; and the third mounting space 70 is below the air inlet 311.

The heat exchanger 20 is fitted at the air inlet of the air inflow section 313; an upper end of the heat exchanger 20 cooperates with the first air inflow plate 3131, and a first sealing structure (not shown) is provided between the upper end of the heat exchanger 20 and the first air inflow plate 3131; a lower end of the heat exchanger 20 cooperates with the second air inflow plate 3132, and a second sealing structure (not shown) is provided between the lower end of the heat exchanger 20 and the second air inflow plate 3132. The first sealing structure and the second sealing structure are used for sealing to prevent air, which has not undergone heat exchange with the heat exchanger 20, from entering the inlet air duct 3136 via a gap between the heat exchanger 20 and the first air inflow plate 3131 or between the heat exchanger 20 and the second air inflow plate 3132, which may otherwise affect a cooling effect of the air conditioner. In some embodiments, the first sealing structure and the second sealing structure are sealing foam.

Since condensate water is generated during the heat exchange process of the heat exchanger 20, in order to prevent the condensate water from flowing into the outlet air duct 3143 and flowing out from the air outlet 312, the second air inflow plate 3132 includes a sunken part 3133 that forms a water receiving sink 3134 for receiving the condensate water from the heat exchanger 20, as shown in FIGS. 1 and 2.

The water receiving sink 3134 is on a side of the sunken part 3133 close to the inlet air duct 3136. For example, the sunken part 3133 is formed in such a way that a part of the second air inflow plate 3132 is recessed in a direction away from the inlet air duct 3136. In some embodiments, the sunken part 3133 may also be seen as a part of the second air inflow plate 3132 protruding into the third mounting space 70. The third mounting space 70 is on a side of the sunken part 3133 facing away the water receiving sink 3134. Since the sunken part 3133 forms the water receiving sink 3134, the sunken part 3133 may also be called a water receiving tray.

In embodiments shown in FIGS. 1 and 2, the water receiving sink 3134 has an opening facing upwards, and the water receiving sink 3134 has a certain depth in the up-down direction. The water receiving sink 3134 is behind the lower end of the heat exchanger 20, i.e., behind the second sealing structure, and the water receiving sink 3134 is also below the heat exchanger 20 to effectively receive the condensate water of the heat exchanger 20.

Further, a part of the first air inflow plate 3131 is recessed outwards to form an avoidance groove 3135 that is located behind the upper end of the heat exchanger 20, i.e., behind the first sealing structure. The avoidance groove 3135 is used to avoid the condensate water generated by the heat exchanger 20 during the heat exchange process and to prevent the condensate water from flowing into the air outflow section 314 along the first air inflow plate 3131. In some embodiments, a part, adjacent to the air outflow section 314, of the first air inflow plate 3131 is recessed outwards to form the avoidance groove 3135. For example, the avoidance groove 3135 is formed in such a way that a part of the second air inflow plate 3132 is recessed in a direction away from the inlet air duct 3136, and the avoidance groove 3135 may also be seen as a part of the second air inflow plate 3132 protruding into the first mounting space 50.

In some embodiments, a rear surface of the first air inflow plate 3131 and/or a rear surface of the first air outflow plate 3141 is provided with a water tank 80 having an opening facing upwards; the first mounting space 50 is above the water tank 80 and the second mounting space 60 is below the water tank 80; and the water tank 80 is arranged obliquely and communicated with the water receiving sink 3134. The water tank 80 is used to receive condensate water formed on the rear surface of the first air inflow plate 3131 and/or the rear surface of the first air outflow plate 3141, and is also used to receive condensate water from the throttling component 91 mounted in the first mounting space 50. The water in the water tank 80 will converge into the water receiving sink 3134 and then be discharged together. The oblique arrangement of the water tank 80 means that the water tank 80 is arranged obliquely in its length direction.

In the embodiments shown in FIGS. 1 and 2, the first air inflow plate 3131 and the first air outflow plate 3141 are connected to form an integrated first wall, while the second air inflow plate 3132 and the second air outflow plate 3142 are connected to form an integrated second wall. The water tank 80 is arranged on a rear surface of the first wall. Further, the water tank 80 is at a rearmost position on the rear surface of the first wall to better receive the condensate water.

As an example, the water tank 80 extends along a length direction of the wall-mounted air conditioner 1 and is obliquely arranged. The water receiving sink 3134 also extends along the length direction of the wall-mounted air conditioner 1 and is obliquely arranged. A tilt direction of the water receiving sink 3134 is the same as a tilt direction of the water tank 80. The length direction of the wall-mounted air conditioner 1 is consistent with a length direction of the air duct 30. The length direction of the air duct 30 is shown by arrow C in FIG. 3. A lower end of the water tank 80 is connected to an upper end of the water receiving sink 3134, and the water in the water tank 80 will converge into the water receiving sink 3134. The lower end of the water receiving sink 3134 is connected to a drainage outlet inside the wall-mounted air conditioner 1, and the water in the water tank 80 and the water receiving sink 3134 can be discharged from the drainage outlet.

As shown in FIGS. 1 and 2, the first air outflow plate 3141 includes a first flat plate portion 3144 adjacent to the air outlet 312, and the second air outflow plate 3142 includes a second flat plate portion 3145 adjacent to the air outlet 312. Inner sides of respective projections of the first flat plate portion 3144 and the second flat plate portion 3145 are both straight lines.

As shown in FIGS. 1 and 2, in a vertical plane perpendicular to the length direction of the air duct 30, a first intersection angle θ1 between the second flat plate portion 3145 and a centerline of the air outflow section 314 is greater than 0 degree and less than or equal to 30 degrees.

It is possible to reduce the space occupied by the outlet air duct 3143 while ensuring the air flow volume inside the outlet air duct 3143 (the air outflow volume of the outlet air duct 3143), and the second mounting space 60 and the third mounting space 70 are large enough to house components, which are originally mounted on a side (such as a left side and/or a right side) of the air duct 30 in the length direction. The length of the wall-mounted air conditioner 1 can be effectively decreased, and the installation difficulty and space required for the wall-mounted air conditioner 1 can be reduced. A left-right direction is shown by arrow E in FIG. 3.

In some embodiments, the first intersection angle θ1 is greater than or equal to 1 degree and less than or equal to 25 degrees. In some embodiments, the first intersection angle θ1 is greater than or equal to 2 degrees and less than or equal to 20 degrees. In some embodiments, the first intersection angle θ1 is greater than or equal to 3 degrees and less than or equal to 10 degrees. The air flow volume inside the outlet air duct 3143 can be increased, and the capacities of the second mounting space 60 and the third mounting space 70 can be enlarged, further improving the cooling and heating effect of the wall-mounted air conditioner 1, further decreasing the length of the wall-mounted air conditioner 1, and further reducing the installation difficulty and space required for the wall-mounted air conditioner 1.

In some embodiments, the first intersection angle θ1 may be but is not limited to 1 degree, 2 degrees, 3 degrees, 4 degrees, 5 degrees, 6 degrees, 7 degrees, 8 degrees, 9 degrees, 10 degrees, 15 degrees, 20 degrees, 25 degrees, or 30 degrees.

A second intersection angle θ2 between the first flat plate portion 3144 and the second flat plate portion 3145 is greater than or equal to 5 degrees and less than or equal to 45 degrees. It is possible to reduce the space occupied by the outlet air duct 3143 while ensuring the air flow volume inside the outlet air duct 3143 (the air outflow volume of the outlet air duct 3143), and the second mounting space 60 and the third mounting space 70 are large enough to house the components, which are originally mounted on the side (such as the left side and/or the right side) of the air duct 30 in the length direction. The length of the wall-mounted air conditioner 1 can be effectively decreased, and the installation difficulty and space required for the wall-mounted air conditioner 1 can be reduced.

In some embodiments, the second intersection angle θ2 is greater than or equal to 10 degrees and less than or equal to 40 degrees. In some embodiments, the second intersection angle θ2 is greater than or equal to 10 degrees and less than or equal to 30 degrees. In some embodiments, the second intersection angle θ2 is greater than or equal to 10 degrees and less than or equal to 20 degrees. The air flow volume inside the outlet air duct 3143 can be increased, and the capacities of the second mounting space 60 and the third mounting space 70 can be enlarged, further improving the cooling and heating effect of the wall-mounted air conditioner 1, further decreasing the length of the wall-mounted air conditioner 1, and further reducing the installation difficulty and space required for the wall-mounted air conditioner 1.

In some embodiments, the second intersection angle θ2 may be but is not limited to 5 degrees, 10 degrees, 11 degrees, 12 degrees, 13 degrees, 14 degrees, 15 degrees, 16 degrees, 17 degrees, 18 degrees, 19 degrees, 20 degrees, 25 degrees, 30 degrees, 35 degrees, 40 degrees, or 45 degrees.

As shown in FIGS. 1 and 2, in the vertical plane perpendicular to the length direction of the air duct 30, a third intersection angle θ3 between a centerline L1 of the air inflow section 313 and a centerline L2 of the air outflow section 314 is greater than or equal to 10 degrees and less than or equal to 85 degrees. It is possible to avoid significant changes in a flow direction of air in the air duct 30, in order to reduce flow resistance against the air and allow the air to flow smoothly in the air duct 30, further improving the cooling and heating effect of the wall-mounted air conditioner 1.

In some embodiments, the third intersection angle θ3 is greater than or equal to 20 degrees and less than or equal to 80 degrees. In some embodiments, the third intersection angle θ3 is greater than or equal to 40 degrees and less than or equal to 75 degrees. In some embodiments, the third intersection angle θ3 is greater than or equal to 60 degrees and less than or equal to 75 degrees. In some embodiments, the third intersection angle θ3 is greater than or equal to 70 degrees and less than or equal to 75 degrees. Consequently, the air can flow more smoothly in the air duct 30 and the cooling and heating effect of the wall-mounted air conditioner 1 can be further improved.

In some embodiments, the third intersection angle θ3 may be but is not limited to 10 degrees, 15 degrees, 20 degrees, 25 degrees, 30 degrees, 35 degrees, 40 degrees, 45 degrees, 50 degrees, 55 degrees, 60 degrees, 65 degrees, 70 degrees, 71 degrees, 72 degrees, 73 degrees, 74 degrees, 75 degrees, 76 degrees, 77 degrees, 78 degrees, 79 degrees, 80 degrees, or 85 degrees.

As shown in FIGS. 1 and 2, in the vertical plane perpendicular to the length direction of the air duct 30, a fourth intersection angle θ4 between the centerline L2 of the air outflow section 314 and a vertical upward direction is greater than or equal to 120 degrees and less than or equal to 155 degrees. In such a way, the air leaving the outlet air duct 3143 can flow downwards and forwards, that is, the wall-mounted air conditioner 1 can discharge cold air (hot air) downwards and forwards, which can further improve the cooling and heating effect of the wall-mounted air conditioner 1. The vertical upward direction is shown by an upward arrow B in FIG. 1.

In some embodiments, the fourth intersection angle θ4 is greater than or equal to 130 degrees and less than or equal to 150 degrees. In some embodiments, the fourth intersection angle θ4 is greater than or equal to 140 degrees and less than or equal to 145 degrees. The flow direction of the cold air (hot air) discharged from the wall-mounted air conditioner 1 can be further optimized to improve the cooling and heating effect of the wall-mounted air conditioner 1.

In some embodiments, the fourth intersection angle θ4 may be but is not limited to 120 degrees, 125 degrees, 130 degrees, 135 degrees, 140 degrees, 141 degrees, 142 degrees, 143 degrees, 144 degrees, 145 degrees, 150 degrees, or 155 degrees.

In the description of the present disclosure, it is to be understood that terms such as "central," "longitudinal," "transverse," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientation as then described or as shown in the drawings under discussion. These relative terms are for convenience and simplicity of description and do not indicate or imply that the devices or elements referred to have a particular orientation and be constructed or operated in a particular orientation. Thus, these terms shall not be construed as limitation on the present disclosure.

In addition, terms such as "first" and "second" are used herein for purposes of description and are not intended to indicate or imply relative importance or significance or to imply the number of indicated features. Thus, the feature defined with "first" and "second" may include one or more of this feature. In the description of the present disclosure, the term "a plurality of" means at least two, such as two or three, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communication or interaction of two elements.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Further, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the above terms throughout this specification are not necessarily referring to the same embodiment or example of the present disclosure. Further, the particular features, structures, materials, or characteristics may be combined in any suitable manner in one or more embodiments or examples.

What is claimed is:

1. A wall-mounted air conditioner, comprising:

an air duct, a housing, wherein an air duct is arranged in the housing, the air duct has an air inlet and an air outlet, and the air duct comprises an air inflow section and an air outflow section connected to each other, at least a part of the air inlet being on a front surface of the housing; and a heat exchanger arranged in the air duct, wherein the air inflow section extends horizontally or obliquely forwards from the air outflow section, to define a first mounting space between the air inflow section and the housing; and a part, adjacent to the air outlet, of the air outflow section extends downwards and forwards from a remaining part of the air outflow section, to define a second mounting space between the air outflow section and the housing, wherein an air duct wall of the air inflow section comprises a first air inflow plate;

wherein a rear surface of the first air inflow plate is provided with a water tank having an opening facing upwards; and wherein the first mounting space is above the water tank and the second mounting space is below the water tank.

2. The wall-mounted air conditioner according to claim 1, further comprising a first component, a second component, and a third component, wherein one or more of the first component, second component, and the third component are mounted in any of the first mounting space, the second mounting space, and the third mounting space.

3. The wall-mounted air conditioner according to claim 2, wherein the first component is mounted in the first mounting space, the second component is mounted in the second mounting space, and the third component is mounted in the third mounting space.

4. The wall-mounted air conditioner according to claim 3, wherein the first component is a throttling component; the second component comprises air conditioner pipelines; and the third component is an electric control component.

5. The wall-mounted air conditioner according to claim 1, wherein:

the air duct wall of the air inflow section further comprises a second air inflow plate, and an air duct wall of the air outflow section comprises a first air outflow plate and a second air outflow plate;

wherein the wall-mounted air conditioner further comprises a third mounting space defined among the second air inflow plate, the second air outflow plate, and a front plate of the housing;

the first mounting space is behind the first air inflow plate, and the second mounting space is behind the first air outflow plate.

6. The wall-mounted air conditioner according to claim 5, wherein the second air inflow plate comprises a sunken part, and the sunken part forms a water receiving sink for receiving condensate water from the heat exchanger.

7. The wall-mounted air conditioner according to claim 6, wherein the third mounting space is on one side of the sunken part facing away the water receiving sink.

8. The wall-mounted air conditioner according to claim 5, wherein:

the first air outflow plate comprises a first flat plate portion adjacent to the air outlet, and the second air outflow plate comprises a second flat plate portion adjacent to the air outlet;

a first intersection angle between the second flat plate portion and a centerline of the air outflow section is greater than 0 degree and less than or equal to 30 degrees; or a second intersection angle between the first flat plate portion and the second flat plate portion is greater than or equal to 5 degrees and less than or equal to 45 degrees.

9. The wall-mounted air conditioner according to claim 1, wherein a third intersection angle between a centerline of the air inflow section and a centerline of the air outflow section is greater than or equal to 10 degrees and less than or equal to 85 degrees.

10. The wall-mounted air conditioner according to claim 1, wherein a fourth intersection angle between a centerline of the air outflow section and a vertical upward direction is greater than or equal to 120 degrees and less than or equal to 155 degrees.

11. The wall-mounted air conditioner according to claim 3, wherein the first component is a throttling component; the second component comprises air conditioner wires; and the third component is an electric control component.

12. The wall-mounted air conditioner according to claim 6, wherein:

a rear surface of the first air outflow plate is provided with a water tank having an opening facing upwards;

the first mounting space is above the water tank and the second mounting space is below the water tank.

13. A wall-mounted air conditioner, comprising:

an air duct;

a housing, wherein the air duct is arranged in the housing, the air duct has an air inlet and an air outlet, and the air duct comprises an air inflow section and an air outflow section connected to each other, at least a part of the air inlet being on a front surface of the housing; and a heat exchanger arranged in the air duct, wherein the air inflow section extends horizontally or obliquely forwards from the air outflow section, to define a first mounting space between the air inflow section and the housing; and a part, adjacent to the air outlet, of the air outflow section extends downwards and forwards from a remaining part of the air outflow section, to define a second mounting space between the air outflow section, wherein an air duct wall of the air inflow section comprises a first air inflow plate; wherein a rear surface of the first air inflow plate is provided with a water tank having an opening facing upwards; and wherein the first mounting space is above the water tank and the second mounting space is below the water tank.

14. The wall-mounted air conditioner according to claim 13, further comprising a first component, a second component, and a third component, wherein one or more of the first component, second component, and the third component are mounted in any of the first mounting space, the second mounting space, and the third mounting space.

15. The wall-mounted air conditioner according to claim 14, wherein the first component is mounted in the first mounting space, the second component is mounted in the second mounting space, and the third component is mounted in the third mounting space.

16. The wall-mounted air conditioner according to claim 15, wherein the first component is a throttling component; the second component comprises air conditioner pipelines; and the third component is an electric control component.

17. The wall-mounted air conditioner according to claim 13, wherein:

the air duct wall of the air inflow section further comprises a second air inflow plate, and an air duct wall of the air outflow section comprises a first air outflow plate and a second air outflow plate;

wherein the wall-mounted air conditioner further comprises a third mounting space defined among the second air inflow plate, the second air outflow plate, and a front plate of the housing;

the first mounting space is behind the first air inflow plate, and the second mounting space is behind the first air outflow plate.

* * * * *